US005507204A

United States Patent [19]

Diffrient

[11] Patent Number: 5,507,204

[45] Date of Patent: Apr. 16, 1996

[54] CRANK HANDLE

[75] Inventor: Niels Diffrient, Ridgefield, Conn.

[73] Assignee: Howe Furniture Corporation, Trumbull, Conn.

[21] Appl. No.: 381,707

[22] Filed: Jan. 31, 1995

[51] Int. Cl.[6] ..... G05G 1/08

[52] U.S. Cl. ..... 74/545; 74/543; 74/546; 74/544; 16/115

[58] Field of Search ..... 74/543, 544, 545, 74/546, 547, 548, 557; 403/359; 123/185.12, 185.13; 254/DIG. 3; 16/115

[56] References Cited

U.S. PATENT DOCUMENTS 1,333,998 3/1920 Shook ..... 123/185.13

3,865,500 2/1975 Newell ..... 74/545

FOREIGN PATENT DOCUMENTS 140296 3/1920 United Kingdom ..... 74/545

*Primary Examiner*—Charles A. Marmor
*Assistant Examiner*—Chong H. Kim
*Attorney, Agent, or Firm*—Parmelee, Bollinger & Bramblett

[57] ABSTRACT

An adjustment crank is mountable to the underside of a table top by a bracket in which it is both rotatable and translatable. The crank includes a tube which carries internal splines. An adjustment shaft extends into the tube and carries mating splines. The crank is translatable between an adjustment position wherein the two sets of splines engage and a stowage position wherein the splines are disengaged.

9 Claims, 1 Drawing Sheet

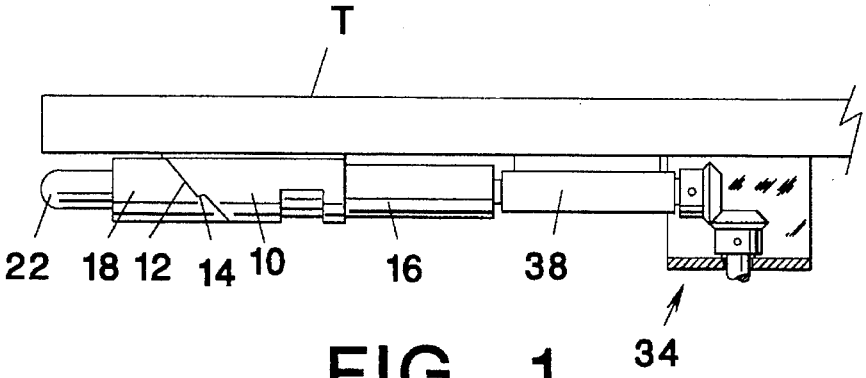
FIG. 1
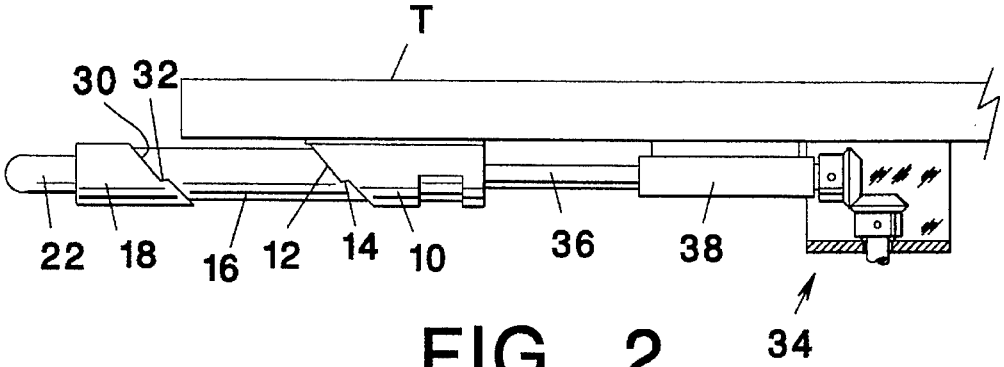
FIG. 2
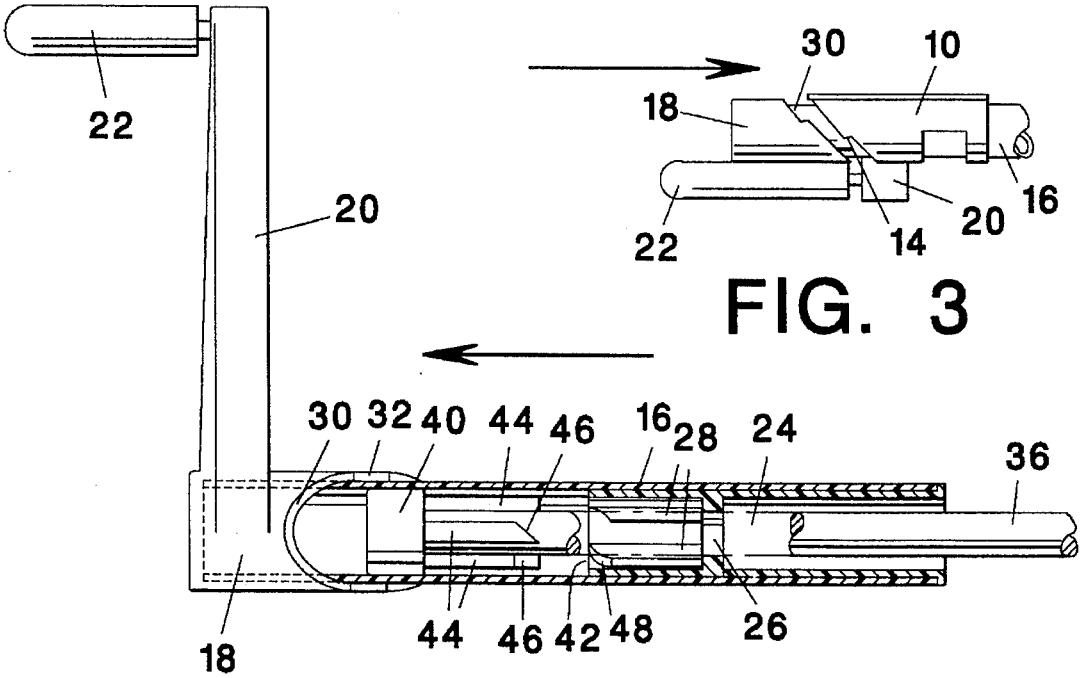
FIG. 3
FIG. 4

CRANK HANDLE

TECHNICAL FIELD

This invention relates to a crank handle. More specifically, it relates to a handle for making mechanical adjustments to tables or desks which can be stowed in an out-of-the-way, inconspicuous location.

BACKGROUND ART

Tables and desks with adjusting mechanisms are well known in the art. Such mechanisms may be employed for adjusting the slant of the working surface of a drafting table or for adjusting the height of a table, bench, desk, or similar furniture. It is also known to employ cranks for making such adjustments. If the crank is an integral part of the furniture, it may be obtrusive or unsightly when not in actual use, especially if it is located near the front of the table, bench, or desk top where it is most accessible. It may, for example, interfere with the user's knees or legs. On the other hand, if the crank is removable when not needed, it can easily be lost or mislaid.

Accordingly, it is the primary object of the present invention to provide a crank handle which is integral with the table, desk, or bench but may be stowed in an inconspicuous location when not in use. Other objects, features, and advantages will become apparent from the following description and appended claims.

DISCLOSURE OF INVENTION

A bracket is mounted on the underneath side of a table top. A cylindrical tube is held within the bracket where it can be both rotated and translated. The tube has splines on its inner surface. Mounted on the forward end of the tube, nearest the front edge of the table top, is a hub with a crank arm extending therefrom. Extending into the back end of the tube is an adjustment shaft which carries external splines which mate with those within the tube. Pushing or pulling of the crank arm causes the tube to slide relative to the adjustment shaft between an adjusting position where the splines are engaged and a stowed position wherein the splines are disengaged. A camming arrangement is activated upon disengaging the splines to return the crank arm to a stowed position parallel to, and immediately adjacent, the underside of the table top.

BRIEF DESCRIPTION OF DRAWINGS

FIG. 1 is an elevational view of the crank of this invention in its stowed position;

FIG. 2 is an illustration similar to FIG. 1 but showing the crank in its engaged position;

FIG. 3 is a partial illustration showing the relationship between the mounting bracket and the crank handle; and FIG. 4 is a plan view, partially broken away, illustrating the internal construction of the crank handle.

BEST MODE FOR CARRYING OUT THE INVENTION

As used in the following description and appended claims, the term "table" will be understood to include tables, desks, benches, and all similar types of furniture.

FIG. 1 is an elevational view showing the front edge of a table top T. Mounted to the underneath side of the table top is a substantially cylindrical bracket 10. The bracket 10 is tubular. The front end 12 of the bracket 10 is cut at a discontinuous angle to form an intermediate step 14 which is angled slightly downwardly toward the front as illustrated. The profile of the bracket's front end as illustrated in FIG. 1 is, of course, repeated in mirror image on the opposite (and unseen) side of the bracket. Carried within the bracket 10 is a cylindrical tube 16. The tube 16 is both rotatable about its longitudinal axis and translatable (longitudinally slidable) within the bracket 10. The front end of the tube 16 is mounted within a cylindrical hub 18. As will be clearest from FIG. 4, a crank arm 20 extends laterally from the hub 18 and on its end is mounted a rotatable knob 22. The hub 18 which carries the crank arm 20 is designed to mate with the angled front end of the bracket 10. Accordingly, as shown in FIG. 2, it is formed with a similarly angled end 30 and step 32.

Integrally mounted within the back end of the tube 16 is a bushing 24. In one embodiment of this invention, both the tube 16 and the bushing 24 are of polycarbonate and they are sonically welded together. The bushing 24 includes an internal bearing ring 26 from which extend a plurality of radially located, forwardly extending, horizontal splines 28.

It will be understood that the crank handle of this invention may be employed to adjust a number of different types of mechanisms. In the version selected for illustration, this mechanism is employed to drive a set of bevel gears 34 which might be used, for example, to drive a table elevating mechanism. The bevel gears 34 are operated by the control end of an adjustment shaft 36 mounted on the underneath side of the table top T by a bearing bracket 38. As shown in FIG. 4, the adjustment shaft 36 extends into the end of the tube 16 and through the bearing ring 26 where it terminates in an enlarged head 40. The head 40 is slidable within the tube 16 like a piston. Relative motion between the two is limited by the forward end 42 of the bushing 24.

Extending rearwardly from the head 40 and along the adjustment shaft 36 are a plurality of radially disposed longitudinally extending splines 44. These splines are engagable with and between the splines 28 which are carried by the bushing 24. The ends 46 of the splines 44 are angled as illustrated, as are the ends 48 of the splines 28.

When the crank handle of this invention is not needed, it is positioned as illustrated in FIG. 1 with the hub 18 latched to the bracket 10 by the interengagement of the step 32 on the hub with the step 14 on the bracket. The crank handle 20 is then parallel to, and closely adjacent, the underneath side of the table top T. In this position, as shown in FIG. 4, the splines 28 carried by the tube 16 are behind, and disengaged from, the splines 44 on the adjustment shaft 36.

When it is desired to make an adjustment, the crank arm 20 is pulled forward, causing the step 14 of bracket 10 and the step 32 of hub 18 to disengage. The tube 16 is pulled in the direction of the arrow shown in FIG. 4 causing the splines 28 carried by the tube 16 to enter between and engage the splines 44 carried by the driven end of the adjustment shaft 36. This engagement is facilitated by the angled ends 42 of the splines 28 camming against the angled ends 46 of the splines 40. When fully engaged, the adjustment shaft 36 may be rotated by turning crank arm 20 using the knob 22.

When the adjustment is completed, the crank arm 20 is returned to the horizontal and pushed inwardly. As illustrated in FIG. 3, if the alignment is not exact, the angled ends of the bracket 10 and the hub 18 will act as camming surfaces to rotate the crank arm 20 to the proper position. It is then latched into position by the interconnection of the step 14 on the bracket 10 with the step 32 on the hub 18.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

I claim:

1. A handle for controlling a table adjusting mechanism which comprises:

a bracket mounted on said table;

a substantially cylindrical tube having first and second ends and a longitudinal axis, said tube being retained within said bracket for rotation around said axis and translation along said axis between a stowed position and an adjusting position;

a first spline on the inner surface of said tube;

a table adjustment shaft having a control end connected to an adjustment mechanism and a driven end extending into the first end of said tube;

a second spline carried by said shaft and engageable with said first spline; and a crank arm carried by the second end of said tube for manually translating said tube between said stowed position wherein said first and second splines are disengaged and an adjusting position wherein said first and second splines are engaged and said tube and shaft are rotatable by said crank arm.

2. The handle of claim 1 wherein said crank arm includes a hub mounted on the second end of said tube and engageable with said bracket when in said stowed position.

3. The handle of claim 2 wherein said hub and bracket comprise camming surfaces which rotate said crank arm into a preselected rotational location as said tube is translated into its stowed position.

4. The handle of claim 3 wherein said bracket is mounted to the underside of a table top and said preselected rotational location is parallel to said underside.

5. The handle of claim 1 wherein the driven end of said shaft extends beyond said first spline and said second spline is carried thereon.

6. The handle of claim 5 wherein said first and second splines are tapered to facilitate engagement therebetween upon translation of said tube into its adjusting position.

7. The handle of claim 5 wherein said crank arm includes a hub mounted on the second end of said tube and engageable with said bracket when in said stowed position.

8. The handle of claim 7 wherein said hub and bracket comprise camming surfaces which rotate said crank arm into a preselected rotational location as said tube is translated into its stowed position.

9. The handle of claim 8 wherein said bracket is mounted to the underside of a table top and said preselected rotational location is parallel to said underside.

* * * * *